US005353101A

United States Patent [19]

Adachi et al.

[11] Patent Number: 5,353,101

[45] Date of Patent: Oct. 4, 1994

[54] CHARGING MEMBER FEATURING A CUT EDGE, AND CHARGING DEVICE EMPLOYING SAME FOR USE IN A DETACHABLE PROCESS UNIT IN AN IMAGE FORMING APPARATUS

[75] Inventors: Hiroyuki Adachi, Tokyo; Norihisa Hoshika, Kawasaki, both of Japan

[73] Assignee: Canon Kabushiki Kaisha, Tokyo, Japan

[21] Appl. No.: 644,549

[22] Filed: Jan. 23, 1991

[30] Foreign Application Priority Data

Jan. 24, 1990 [JP] Japan ..... 2-014094
Jan. 24, 1990 [JP] Japan ..... 2-014096

[51] Int. Cl.[5] ..... G03G 15/02

[52] U.S. Cl. ..... 355/219; 29/882; 355/224; 361/225

[58] Field of Search ..... 355/246, 224, 245, 219; 118/653, 657, 647; 430/126; 29/889.7, 745–746, 825, 882; 361/225, 221

[56] References Cited

U.S. PATENT DOCUMENTS

| | | | |
|---|---|---|---|
| 3,597,829 | 8/1971 | Wagner | 29/420.5 |
| 3,731,354 | 5/1973 | Rayburn | 29/25.42 |
| 4,223,321 | 9/1980 | Kenworthy | 29/846 X |
| 4,265,197 | 5/1981 | Toyono et al. | 118/657 |
| 4,387,980 | 6/1983 | Ueno et al. . | |
| 4,439,781 | 3/1984 | Yano | 346/153.1 |
| 4,521,502 | 6/1985 | Sakai et al. | 355/326 X |
| 4,654,749 | 3/1987 | Kanai | 29/25.42 X |
| 4,696,255 | 9/1987 | Yano et al. | 118/653 |
| 4,739,544 | 4/1988 | Okazaki et al. | 29/25.42 |
| 4,819,325 | 4/1989 | Cross et al. | 29/825 |

FOREIGN PATENT DOCUMENTS

| | | |
|---|---|---|
| 0308185 | 3/1989 | European Pat. Off. . |
| 0312230 | 4/1989 | European Pat. Off. . |
| 0439145 | 7/1991 | European Pat. Off. . |
| 127324 | 10/1979 | Japan . |
| 56-165166 | 12/1981 | Japan . |
| 59-197071 | 11/1984 | Japan . |
| 60-147756 | 8/1985 | Japan . |
| 61-158364 | 7/1986 | Japan . |
| 2282280 | 11/1990 | Japan . |

*Primary Examiner*—A. T. Grimley
*Assistant Examiner*—Thu Dang
*Attorney, Agent, or Firm*—Fitzpatrick, Cella, Harper & Scinto

[57] ABSTRACT

A charging member for charging a member to be charged includes a blade member having an electrode layer and/or a resistive layer thereon, and a supporting member for supporting the blade member. The blade member is cut into a predetermined size together with the electrode layer and/or the resistive layer after forming the electrode layer and/or the resistive layer. A charging device uses the charging member. A process unit including the charging device is detachable relative to an image forming apparatus.

24 Claims, 10 Drawing Sheets

CHARGING MEMBER FEATURING A CUT EDGE, AND CHARGING DEVICE EMPLOYING SAME FOR USE IN A DETACHABLE PROCESS UNIT IN AN IMAGE FORMING APPARATUS

BACKGROUND OF THE INVENTION

1. Field of the Invention

This invention relates to a charging member and a charging device for charging a member to be charged, an image forming apparatus, such as an electrophotographic apparatus or the like, having the charging device, and a process unit detachable relative to the apparatus.

2. Description of the Related Art

A corona discharger, such as a corotron, a scorotron of the like, having a wire electrode and a shield electrode surrounding the wire electrode and having an excellent charging uniformness has been widely used as means for uniformly charging the surface of an image carrying member, such as a photosensitive member, a dielectric member or the like, serving as a member to be charged in an image forming apparatus, such as an electrophotographic copier, an electrophotographic printer, a recording apparatus or the like.

However, the corona discharger has the following problems: An expensive high-voltage power supply is needed. Space is needed for the charger itself, as shield space for the high-voltage power supply, and the like. A large amount of corona products, such as ozone and the like, are produced, and hence additional means and mechanisms are needed in order to deal with the corona products. These factors result in a large and expensive apparatus.

In consideration of the above-described problems, the adoption of a contact charging method has recently been studied as an alternative to the corona discharger.

In contact charging, by contacting a contact charging member, to which a voltage (for example, a DC voltage of about 1–2 kV (kilovolts), or a superposed voltage composed of a DC voltage and an AC voltage) is applied from a power supply, to the surface of an image carrying member, serving as a member to be charged, the surface of the image carrying member is charged at a predetermined potential. Various contact charging methods have been devised, for example, a roller charging method (Japanese Patent Application Public Disclosure (Kokai) No. 56-91253 (1981)), a blade charging method (Japanese Patent Application Public Disclosure (Kokai) Nos. 56-104349 (1981) and 60-147756 (1985)), and a charging-and-cleaning method (Japanese Patent Application Public Disclosure (Kokai) No. 56-165166 (1981)), (U.S. Pat. No. 4,387,980 corresponds to Japanese Patent Document Nos. 56-91253 and 56-104349.)

Among such contact charging methods, the blade charging method is particularly effective for a small image forming apparatus because it provide for an inexpensive and compact apparatus.

One of the problems associated with the contact charging methods including the blade charging method is as follows: If a pinhole portion (i.e., a surface defect portion in a member to be charged) is present in an image carrying member, such as a photosensitive member or the like, a spark discharge is apt to occur between a contact charging member, to which a voltage is applied, in contact with the surface of the image carrying member in order to charge the surface of the image carrying member and the pinhole portion in the image carrying member. If such discharge occurs once, a so-called "charge leak" phenomenon will easily subsequently occur on the surface of the image carrying member wherein charged electric charges are held not only on the pinhole portion but also over the entire surface (the direction of the generatrix of a rotating image carrying member) of the charged region including the pinhole portion in contact with the contact charging member.

Fur purposes of background information, FIGS. 7(A) and 7(B) illustrates a model for explaining the charge leak phenomenon. In FIG. 7(A), a photosensitive member 1 serves as an image carrying member (a member to be charged) whose surface moves in the direction of the arrow. Pinhole portions P are present in the photosensitive member 1. A blade member 2 (hereinafter termed a "charging blade") of a contact charging member to which a voltage is applied is in contact with the surface of the photosensitive member 1 in order to charge the surface, FIG. 7(B) is an equivalent circuit of FIG. 7(A).

The pinhole portions P in the photosensitive member 1 have lower resistance values than other portions. Hence, when the charging blade 2 contacts the pinhole portions P or the surface of the charging blade 2 comes close to the pinhole portions P, spark discharges 5 are apt to occur between the charging blade 2 and the pinhole portions P. When the discharges S occur, potentials $V_A$, $V_B$, - - - $V_Z$ at respective portions applied on the surface of the photosensitive member 1 in the direction of the longitudinal direction of the photosensitive member 1 (the direction of the generatrix of the photosensitive member 1) become almost 0 V (volt). As a result, electric charge cannot be held on the surface of the photosensitive member 1 over the entire surface of the contact charging region including the pinhole portions P in contact with charging blade 2.

When the above-described charge leak portions are produced in the charging processing of the surface of the photosensitive member 1, image portions corresponding to the charge leak portions in an output image appear as white stripes in normal development and black stripes in reversal development, causing deterioration in image quality.

The pinholes P are apt to be produced, for example, during the production of an image carrying member (a member to be charged), such as a photosensitive member or the like, due to scratching, or due to dielectric breakdown. It is rather difficult to completely eliminate pinholes.

In order to prevent the above-described charge leaks, it is necessary to increase the electric resistance of the charging blade material. Since the charging blade 2 is pressed with a proper pressure utilizing rubber elasticity, the distance (the free length of the blade) between the distal end of a supporting member for the charging blade and a portion of the charging blade 2 in contact with the member to be charged must be considerably larger than the thickness of the blade 2. Accordingly, when a voltage is applied from the blade supporting member to the blade 2, the voltage drop in the blade 2 becomes large, causing a decrease in the potential of the portion of the blade 2 in contact with the member to be charged. Hence, it is necessary to attach a back electrode to the charging blade 2, but there has been no excellent means for producing a charging blade having a back electrode.

In order to prevent the charge leak, a resistive layer having a resistance value so large as not to produce charge leaks may be formed on the surface of the charging blade in contact with the member to be charged, but it is difficult to form the layer very accurately at a predetermined position.

SUMMARY OF THE INVENTION

The present invention has been made in consideration of the above-described problems.

The present invention in one aspect pertains to a charging member for charging a member to be charged, comprising a blade member having an electrode layer formed on a surface thereof, and a supporting member for supporting the blade member relative to the member being charged wherein the blade member has been cut into a predetermined size together with the electrode layer after forming the electrode layer.

The invention is another aspect pertains to a charging device for charging a member to be charged, comprising a blade member for contacting the member to be charged, an electrode layer being provided on a surface of the blade member opposite to a surface of the blade member in contact with the member to be charged, wherein the blade member has been cut into a predetermined size together with the electrode layer after forming the electrode layer, and a cut portion of the blade member being disposed as so to contact the member to be charged.

The invention in still a further aspect pertains to a process unit detachable relative to an image forming apparatus, comprising an image carrying member, and charging member in order to form an image on the image carrying member, the charging means comprising a blade member for contacting the image carrying member, and a supporting member for supporting the blade member relative to the image carrying member, and the blade member comprising an electrode layer provided on a surface of the blade member opposite to a surface of the blade member in contact with the image carrying member wherein the blade member has been cut into a predetermined size together with the electrode layer after forming the electrode layer, and a cut portion of the blade member being disposed so as to contact the image carrying member.

The invention in yet another aspect pertains to an image forming apparatus comprising an image carrying member, image forming means for forming an image on the image carrying member, and charging means for charging the image carrying member, the charging means comprising a blade member for contacting the image carrying member, and a supporting member for supporting the blade member relative to the image carrying member, and the blade member comprising an electrode layer provided on a surface of the blade member opposite to a surface of the blade member in contact with the image carrying member, wherein the blade member has been cut into a predetermined size together with the electrode layer after forming the electrode layer, and a cut portion of the blade member being disposed so as to contact the image carrying member.

The present invention in still a further aspect pertains to a charging member for charging a member to be charged, comprising a blade member having a resistive layer formed on a surface thereof and a supporting member for supporting the blade member relative to the member being charged, wherein the blade member has been cut into a predetermined size together with the resistive layer after forming the resistive layer.

The present invention in another aspect pertains to a charging device for charging a member to be charged, comprising a blade member for contacting the member to be charged, a resistive layer being provided on a surface of the blade member in contact with the member to be charged, and a supporting member for supporting the blade member relative to the member being charged, wherein the blade member has been cut into a predetermined size together with the resistive layer after forming the resistive layer, and a cut portion of the blade member being disposed so as to contact the member to be charged.

The present invention in yet another aspect pertains to a process unit detachable relative to an image forming apparatus, comprising an image carrying member, and charging means for charging the image carrying member in order to form an image on the image carrying member, the charging means comprising a blade member for contacting the image carrying member, and a supporting member for supporting the blade member relative to the image carrying member, and the blade member comprising a resistive layer provided on a surface of the blade member, wherein the blade member has been cut into a predetermined size together with the resistive layer after forming the resistive layer, and a cut portion of the blade member is disposed so as to contact the image carrying member.

The present invention in still a further aspect pertains to an image forming apparatus comprising an image carrying member, image forming means for forming an image on the image carrying member, and charging means for charging the image carrying member in order to form the image on the image carrying member, the charging means comprising a blade member for contacting the image carrying member, and a supporting member for supporting the blade member relative to the image carrying member, and the blade member comprising a resistive layer provided on a surface of the blade member in contact with the image carrying member, wherein the blade member has been cut into a predetermined size together with the resistive layer, and a cut portion of the blade member being disposed so as to contact the image carrying member.

The present invention in one aspect pertains to a method for making a charging member for charging a member to be charged, comprising the steps of providing a blade member, forming an electrode layer on a surface of the blade member, connecting the blade member to the supporting member, and cutting the blade member and the electrode layer at the same time.

The present invention in another aspect pertains to a method for making a charging member for charging a member to be charged, comprising the steps of providing a blade member, forming a resistive layer on a surface of the blade member, connecting the blade member to the supporting member, and cutting the blade member and the resistive layer at the same time.

These and other objects and features of the present invention will become more apparent from the following detailed description taken in connection with the accompanying drawings.

DETAILED DESCRIPTION OF THE PREFERRED EMBODIMENTS

Preferred embodiments of the present invention will now be explained with reference to the drawings.

Figure 2:
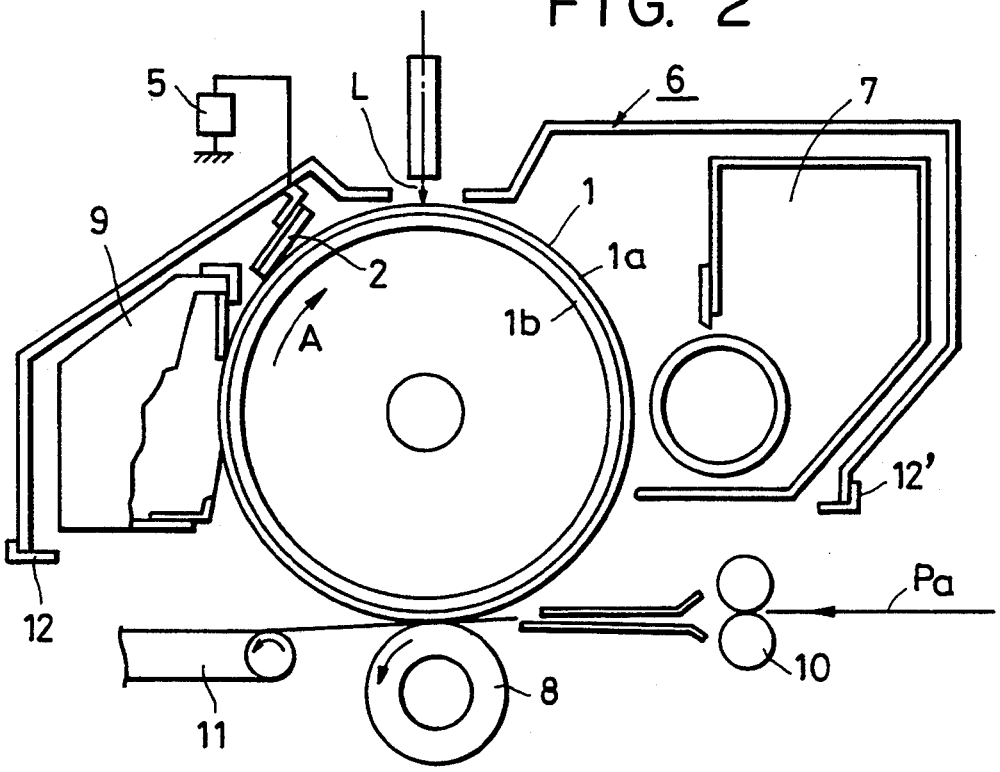
FIG. 2 is a schematic diagram of an image forming apparatus incorporating a contact charging device using a charging blade.

FIG. 2 is a schematic diagram of the configuration of a principal part of an image forming apparatus which incorporates a contact charging device using a contact charging member according to the present invention as the charging processing means for an image carrying member.

In FIG. 2, a rotating-drum-type electrophotographic photosensitive member (termed hereinafter a "photosensitive drum") 1 serves as an image carrying member.

The photosensitive drum 1 is composed of an organic photoconductive layer 1*a* which is a surface layer, and a grounded conductive substrate 1*b* made, for example, of aluminum for supporting the organic photoconductive layer 1*a*.

The photosensitive drum 1 is rotatably driven in the clockwise direction as shown by arrow A at a predetermined circumferential speed (process speed).

The photosensitive drum 1 is uniformly charged at a predetermined polarity and a predetermined potential during its rotation by a charging blade 2 serving as a contact charging member of a contact charging device (to be described later).

Subsequently, the charged surface of the photosensitive drum 1 is subjected to exposure L (for example, exposure by an analog optical system for imaging and exposing the image of an original, scanning exposure by a digital optical system including a laser-beam scanner, an LED array or the like) in accordance with object image information at a exposing portion. Thus, an electrostatic latent image corresponding to the object image information is formed.

The formed latent image is then subjected to normal or reversal development using toner by a developing unit 7.

On the other hand, a transfer material Pa is fed from a paper feed mechanism (not shown), and is supplied to a space (transfer potion) between the photosensitive drum 1 and a transfer roller 8 (for example, a corona charger may also be used), serving as transfer means, with a predetermined timing by registration rollers 10. The developed image formed on the photosensitive drum 1 is sequentially transferred to the fed transfer material Pa.

The transfer material Pa passing through the transfer portion is separated from the surface of the photosensitive drum 1, and is guided into a fixing unit (not shown) by feed means 11. The image on the transfer material Pa is fixed in the fixing unit.

Unnecessary particles remaining on the surface of the photosensitive drum 1 after image transfer are removed by a cleaning unit 9, and the photosensitive drum 1 is repeatedly used for forming images.

The image forming apparatus of the present embodiment is constituted as a process unit 6 wherein the four process devices, that is, the photosensitive drum 1, the charging blade 2, the developing unit 7 and the cleaning unit 9, are incorporated as a unit with a predetermined mutual positional relationship. The process unit 6 can be mounted by inserting it into the main body of the image forming apparatus along supporting rails 12, 12' in the direction perpendicular to the plane of FIG. 2. The unit 6 is also detachable from the main body of the image forming apparatus. The process unit 6 may comprise the photosensitive drum 1 and the charging blade 2.

By sufficiently inserting the process unit 6 within the main body of the image forming apparatus, the main body of the apparatus and the unit 6 are mechanically and electrically coupled with each other, and the image forming apparatus assumes an operable state.

Figure 1:
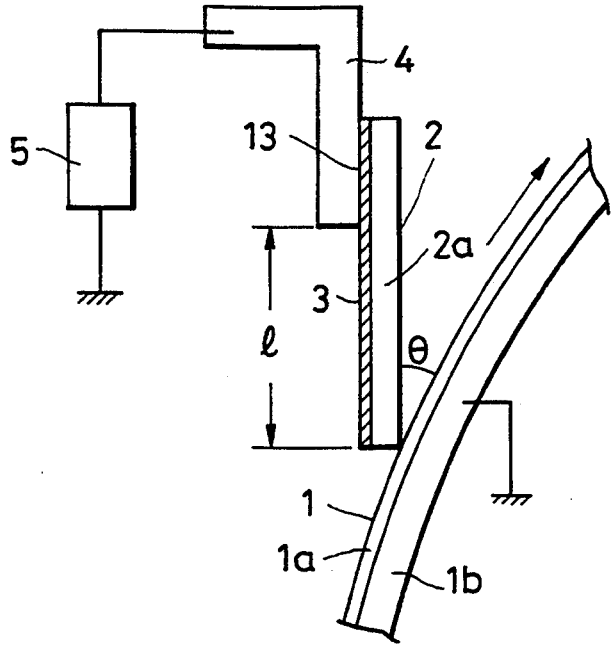
FIG. 1 is a schematic diagram of a charging blade portion of a contact charging device.

FIG. 1 is a model diagram of the contact charging device portion of the image forming apparatus shown in FIG. 2.

The charging blade 2, serving as a contact charging member, has a substrate 2*a* consisting, for example, of an elastic rubber blade 1–2 mm thick made of hydrin, EPDM (ethylene/propylene/diene terpolymer), urethane or the like whose volume resistivity is controlled to about $10^7$–$10^9$ Ω.cm. The base portion of the charging blade 2 is mounted on a conductive regid supporting member 4, made of a steel plate or the like, as a unit using an adhesive or the like. Alternatively, the charging blade 2 and the supporting member 4 are molded and held as a unit by injecting the blade material into a metal mold. By setting the free length l (the distance between the distal end of the blade supporting member and the portion of the blade 2 in contact with the photosensitive drum 1) of the blade 2 to about 5–15 mm, the contact angle $\theta$ (the angle made by the distal end of the blade 2 and the downstream tangent line from the contact point of the blade 2 with the drum 1 in the direction of the movement of the surface of the drum 1 at the contact point) relative to the photosensitive drum 1 to about 8°–25°, and the contact pressure to about 4–40 gr/cm, the distal end of the blade 2 contacts the drum 1 in the counter direction (the contact angle is an acute angle) relative to the rotation of the photosensitive drum 1. The contact of the charging blade 2 with the photosensitive drum 1 may also be in the forward direction (the contact angle is an obtuse angle) relative to the rotation of the drum 1.

On a surface (i.e., the back of the blade 2) opposite to a surface in contact with the photosensitive drum 1 is formed a back electrode 3 having a volume resistivity of $10^2$–$10^3$ Ω.cm by printing with a conductive paint made of polyurethane and the like. The back electrode 3 and the conductive rigid supporting member 4 for the charging blade 2 are connected together via a conductive adhesive 13, and are thereby electrically connected. Any material having a volume resistivity of $10^5$ Ω.cm or less may be used for the electrode layer. As described above, the contact charging member includes the charging blade 2 having the substrate 2*a* and the electrode layer 3, and the supporting member 4.

A power supply 5 for applying a voltage to the charging blade 2 applies to the conducting rigid supporting member 4 of the charging blade 2, for example, a DC voltage corresponding to a potential necessary for the photosensitive drum 1, or a bias voltage obtained by superposing an alternating voltage having a peak-to-peak voltage at least twice the discharge starting voltage ($V_{TH}$) determined from the charging blade 2 and the photosensitive drum 1 with the DC voltage in order to obtain uniform charging. The discharge staring voltage is an applied DC voltage with which charging of the photosensitive drum starts when only DC voltage is applied between the charging blade, serving as the contact charging member, and the photosensitive drum, serving as the member to be charged.

The above-described superposed bias voltage is a voltage whose value periodically changes. It may, for example, be a sinusoidal-wave AC voltage, or a rectangular-wave AC voltage which is formed by periodically switching on and off a DC power supply.

As described above, by applying a bias voltage to the conductive rigid supporting member 4, a voltage is applied to the charging blade 2 via the supporting member 4, the conductive adhesive 13 connecting the supporting member 4 to the charging blade 2, and the back electrode 3. As a result, an electric field is produced at the contact portion between the charging blade 2 and the photosensitive drum 1, and the surface of the photosensitive drum 1 is thereby uniformly charged at a predetermined polarity and a predetermined potential.

Figure 3A:
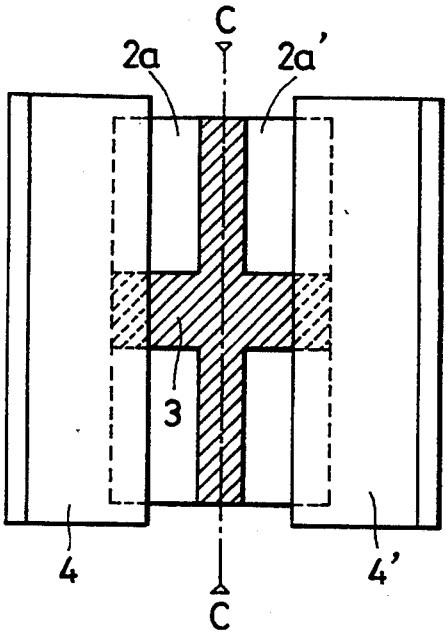
FIG. 3(A) is a diagram illustrating how charging blades are formed.

In FIG. 3(A), an elastic rubber blade 2*a*, serving as the substrate of the charging blade 2, is sized to provide two sheets of charging blades having a predetermined size. If the rubber blade 2*a* is cut along its longitudinal central axis C—C, two substrates of charging blades having the predetermined size are obtained.

On the back of the rubber blade 2*a* having the size for two sheets is formed a pattern of the back electrode layer 3 having a cross-like region shown by hatching symmetrically relative to the longitudinal central axis C—C by printing with a conductive paint.

Conductive rigid supporting members 4, 4' are connected to the left and right side portions of the rubber blade 2*a* having the size for two sheets as one body symmetrically relative to the axis C—C using the conductive adhesive 13. Subsequently, by cutting the rubber blade 2*a* along the longitudinal central axis C—C, two charging blades are obtained.

Figures 3B, 3C:
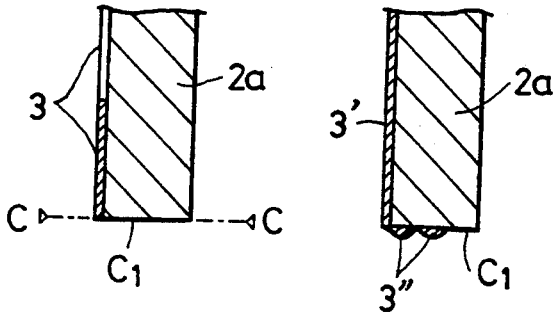
FIG. 3(B) is an enlarged view of a cut distal-end portion of a charging blade.
FIG. 3(C) is a diagram showing a state wherein a coated electrode-layer material has moved on a side end of the cut distal-end portion of the blade.

By forming the electrode layer 3 on the blade 2*a* as described above, and subsequently cutting the rubber blade 2*a* and the electrode layer 3, it is possible to precisely form a cut surface $C_1$, as shown in FIG. 3(B).

The back electrode layer 3 need not be formed on the entire surface of the back of the blade 2*a*, but it is sufficient if there are a back portion of the blade 2*a* corresponding to the distal-end portion of the blade in contact with the photosensitive drum 1, and a connecting portion for electrically connecting that portion to the supporting member 4, serving as the voltage supply side, as the T-like pattern (the pattern after cutting along the axis C—C) in the present embodiment.

With reference to FIG. 3(C), if an electrode layer 3' is formed by printing an electrode-layer material on the back of the rubber blade 2*a* after the connection/cutting, electric charge leaks may occur in some cases, for example, due to the movement of the coated electrode-layer material on the neighborhood of the contact portion, as shown by reference numeral 3''.

Figure 4:
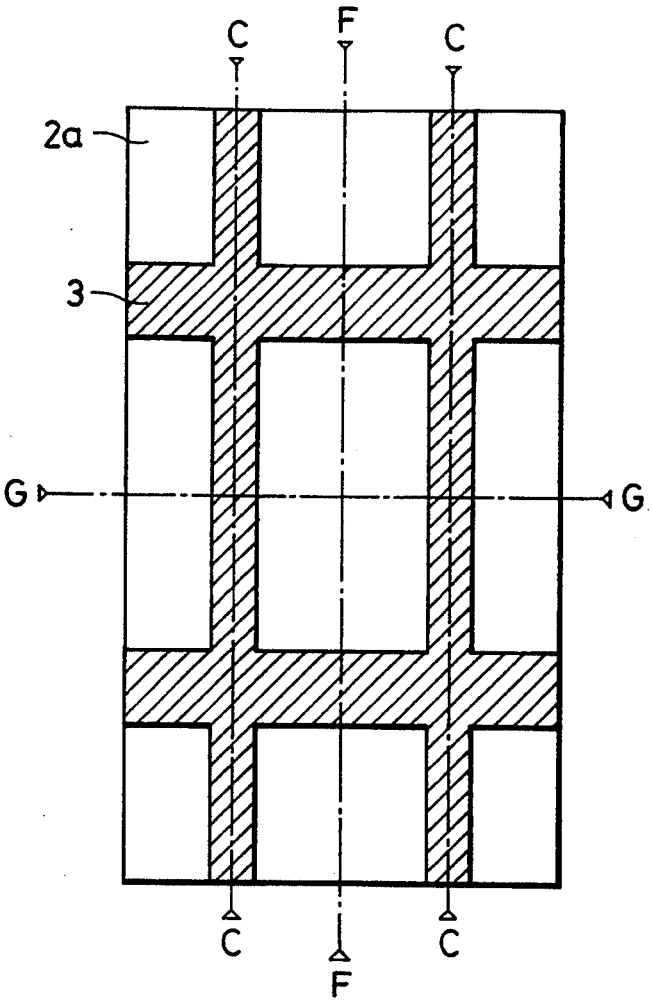
FIG. 4 is a diagram showing a back-electrode pattern formed on the back of a rubber blade having a size for eight sheets of charging blades.

In FIG. 4, a rubber sheet 2*a*, serving as the substrate of the charging blade 2, has the size to provide eight sheets of charging blades having a predetermined size. On the back of the rubber sheets 2*a* having the size for eight sheets is formed a pattern of the back electrode layer 3 having a latticed region shown by hatching by printing with a conductive point.

By cutting the rubber sheet 2*a* along lines F—F and G—G, four charging blades having the size for two sheets shown in FIG. 3(A) are formed. The supporting members 4, 4' are connected to the respective blade in the same manner as in FIG. 3(A), and then the resultant member is cut into two pieces. Thus, eight charging blades are formed.

Although the blade having the size for eight sheets is cut in the FIG. 4 embodiment, more blades may be formed from one mother blade in the same manner. Mass productivity increases as the number of blades increases.

As described above, since the electrode layer is formed on the rubber blade and subsequently the resultant member is connected to the supporting members, mass productivity increases compared with a case wherein an electrode layer is formed after connecting a rubber blade to supporting members. Furthermore, since it is also difficult to form an arbitrary electrode pattern by masking after the connection, it is preferred to perform the connection after forming an electrode layer.

Figure 5:
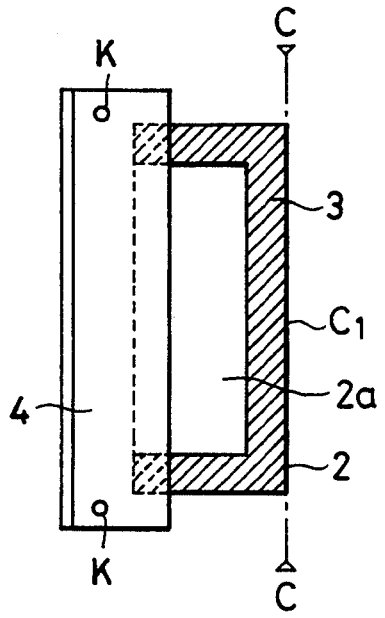
FIG. 5 is a plan view of another example of the configuration of a charging blade.

As shown in FIG. 5, a charging blade 2 may be formed by cutting a rubber blade 2*a* after forming an electrode layer 3 thereon, the charging blade 2 may be connected using the adhesive (not shown) to a supporting member 4 in reference to position reference K provided on the supporting member 4. The electrode layer 3 in this embodiment has a -like pattern composed of a portion along the distal end and the right and left sides of the blade 2 on the back of the blade 2.

Figure 6A:
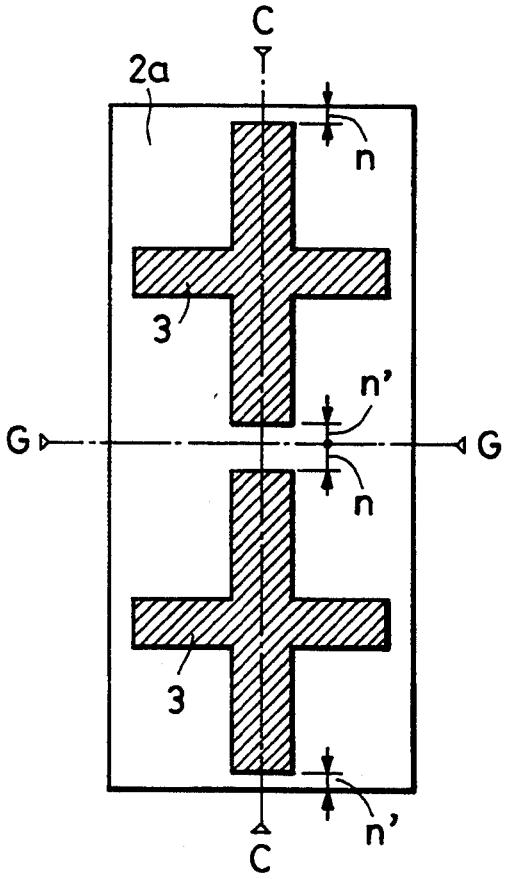
FIGS. 6(A) and 6(B) illustrate still another example of the configuration of a charging blade.
Figure 6B:
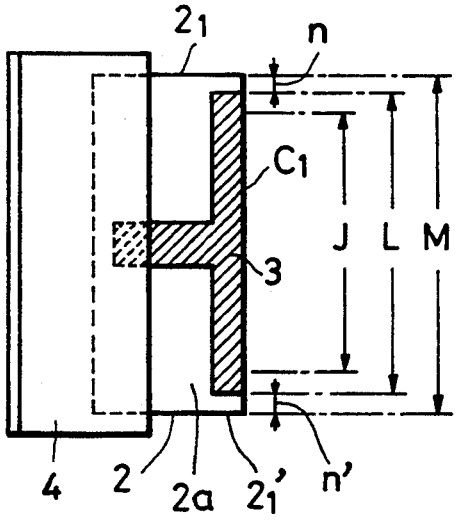
Figure 7A:
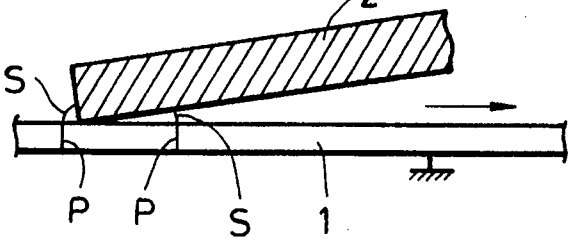
FIG. 7(A) is a model diagram for explaining a charge leak phenomenon.
Figure 7B:
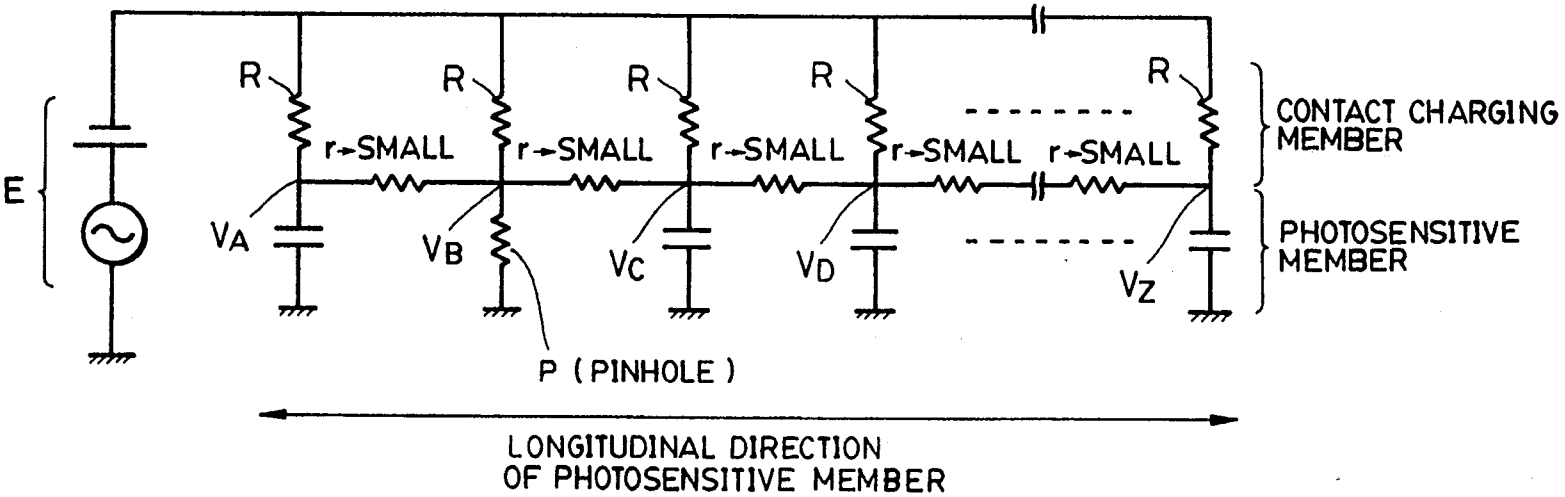
FIG. 7(B) is an equivalent circuit of FIG. 7(A)

As shown in FIGS. 6(A) and 6(B), by not providing an electrode layer on portions n and n' in the direction of the generatrix of the charging blade 2 in contact with the photosensitive drum 1, it is possible to effectively prevent a charge leak phenomenon from the right and left ends $2_1$, $2_1$ of the charging blade 2 to the conductive substrate of the drum 1 which occurs when the width of the photosensitive drum 1 is equal to or a little larger than the width of the charging blade 2 in the direction of the generatrix of the drum 1.

As a matter of course, if the width (the width of an image) of the image (toner image) forming region of the photosensitive drum 1 in the direction of its generatrix is represented by J, the following relationship holds:

The width J of the image < the width L of the back electrode < the width M of the charging blade.

Although an explanation has been provided of the rubber blade, a sheet material or a film material may also be used as the substrate of the charging blade. The back electrode layer 3 may be formed and configured in the same manner as described above.

Figure 8:
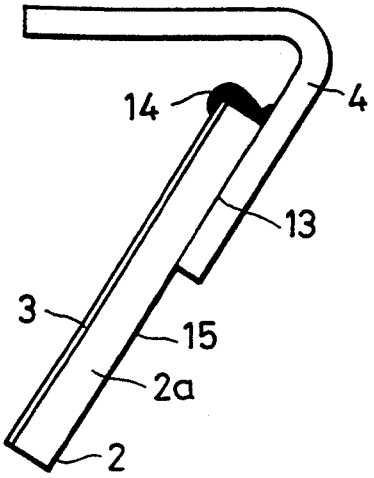
FIGS. 8(A), 8(B), 8(C), 8(D), 9, 14 and 15 are side views showing still other embodiments of the configuration of charging blades.
Figure 8:
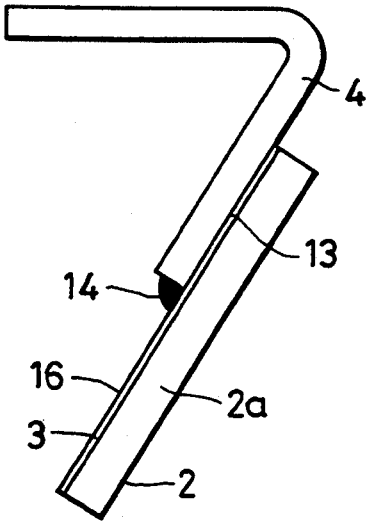
Figure 8C:
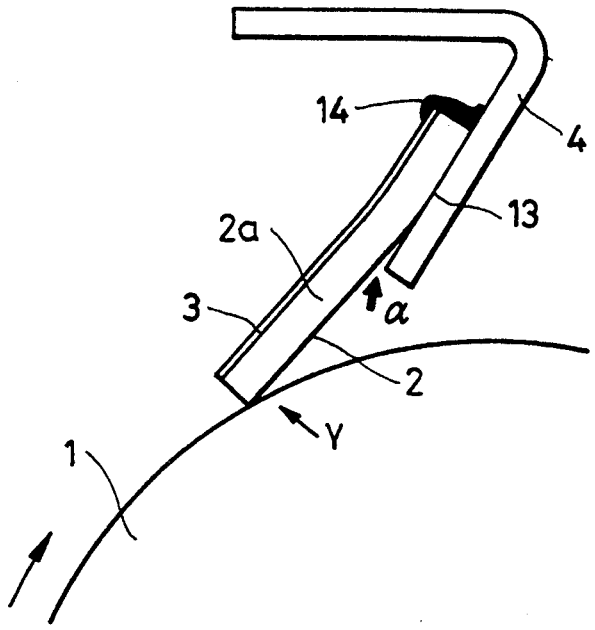
Figure 8D:
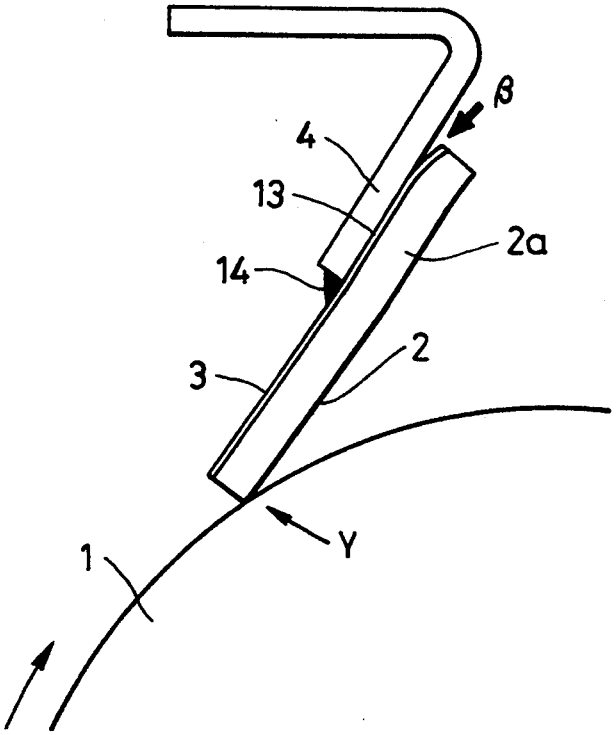

FIGS. 8(A) and 8(B) show two kinds of cross sections of charging members having different connecting surfaces between the rubber blade 2*a*, serving as the conductive elastic member, and the conductive rigid supporting member 4. In FIG. 8(A), a surface 15 of the rubber blade 2*a* in contact with the photosensitive drum 1 serves as the connecting surface. In FIG. 8(B), a surface (the back surface) 16 which is opposite to a surface in contact with the photosensitive drum 1 of the rubber blade 2*a* and which has the electrode layer 3 serves as the connecting surface. The electrode layer 3 and the supporting member 4 are connected together using a conductive paint 14, and are thereby electrically connected. If the two charging blades 2 shown in FIGS. 8(A) and 8(B) are compared with each other in consideration of the ease in coating of the conductive paint 14 for electrically connecting the back electrode 3 and the conductive rigid supporting member 4, the charging blade shown in FIG. 8(B) is superior, as is apparent from FIGS. 8(A) and 8(B). That is, in the charging blade 2 shown in FIG. 8(B), the distance between the conductive rigid supporting member 4 and the back electrode 3 is very small (only the thickness of the adhesive 13), and the position where the conductive paint 14 is coated is situated not so deep as in the case of the blade 2 shown in FIG. 8(A). Hence, work can be performed more easily, and a smaller quantity of conductive paint 14 is needed. Accordingly, it is preferred that the connecting surface of the charging blade 2 is the surface (the back surface) opposite to the surface in contact with the photosensitive drum 1. The connecting surfaces is preferred to be the opposite surface also from another point of view. The reason is as follows: FIGS. 8(C) and 8(D) show a state wherein the charging blade 2 is in contact with the photosensitive drum 1 with a predetermined pressure, and receives a force Y from the photosensitive drum 1 as a reaction force of the pressing force. If it is assumed that the bonding force of the conductive adhesive 13 has decreased and peeling of the bonded portion between the blade 2 and the supporting member 4 has thereby occurred due to the force Y, the peeling occurs at positions $\alpha$ and $\beta$ in FIGS. 8(C) and 8(D), respectively. When the charging blade 2 has peeled off at position $\alpha$ in FIG. 8(C), the contact pressure decreases, and it becomes impossible to perform a stable contact, causing problems, such as insufficient charging. However, even if the charging blade 2 has peeled off at position $\beta$ in FIG. 8(D), the peeling does not influence the contact pressure, and it is therefore possible to obtain a stable image. Accordingly, from the viewpoint of bonding strength and of stability when a small amount of peeling occurs due to a decrease in the bonding force, it is preferred that the bonding surface of the charging blade 2 is the face (the back surface) opposite to the surface in contact with the photosensitive drum 1.

As explained above, by connecting the charging blade 2 to the conductive rigid supporting member 4 after previously forming the back electrode 3 on the rubber blade 2*a*, (1) mass productivity increases, and (2) the pattern of the electrode layer can be easily formed with high accuracy. By bonding the surface having the back electrode 3 to the conductive rigid supporting member 4, it becomes possible to reduce (1) the number of production processes, and (2) to secure stable bonding. By cutting the rubber blade 2*a* together with the electrode 3 after bonding the electrode 3 to the supporting member 4, the ability to achieve accuracy in edges and dimensions when contacting the cut blade edge to the surface of the photosensitive drum, serving as the member to be charged, is improved. Furthermore, by making the width of the back electrode smaller than the width of the charging blade in the direction of the generatrix of the photosensitive drum, it becomes possible to easily prevent leak from the right and left end surfaces of the blade.

Figure 9:
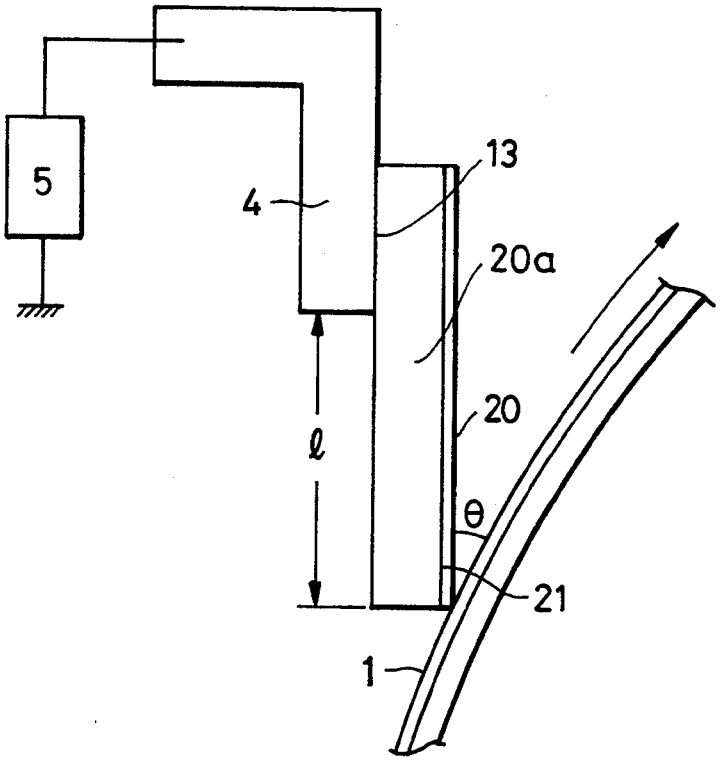

FIG. 9 shows another embodiment of the blade-like charging member applicable to the image forming apparatus shown in FIG. 2.

A charging blade 20, serving as a contact charging member, has a substrate 20*a* consisting, for example, of a rubber blade 1–2 mm thick made of hydrin, EPDM, urethane, NBR or the like whose volume resistivity is controlled to about $10^5$–$10^6$ Ω.cm. The base portion of the blade 20 is mounted and held on a conductive rigid supporting member 4, made of a steel plate or the like, in the same manner as descried in the foregoing embodiment, as a unit using a conductive adhesive 13.

A resistive surface layer 21 for preventing charge leaks provided on a portion in contact with the photosensitive drum 1 of the charging blade 20 is a thin layer 2–100 μm thick made of nylon, urethane or the like whose volume resistivity is controlled to about $10^6$–$10^{12}$ Ω.cm, and is printed on the rubber blade 20*a*.

By setting the free length l (the distance between the distal end of a supporting portion of the blade supporting member 4 and the free end of the blade 20) of the blade 20 to about 5–20 mm, the contact angle $\theta$ (the angle made by the distal end of the blade 20 and the downstream tangent line from the contact point of the blade 20 with the drum 1 in the direction of the movement of the surface of the drum 1 at the contact point) relative to the photosensitive drum 1 to about 8°–25°, and the contact pressure to about 4–40 gr/cm, the distal end of the blade 20 contacts the drum 1 in the counter direction (the contact angle is an acute angle) relative to the rotation of the photosensitive drum 1. The contact of the charging member with the photosensitive drum 1 may also be in the forward direction (the contact angle is an obtuse angle) relative to the rotation of the drum 1.

A power supply 5 for applying a voltage to the charging blade 20 has the same configuration as that described above, and applies a voltage to the conductive rigid supporting member 4 of the charging blade 20.

Figure 10A:
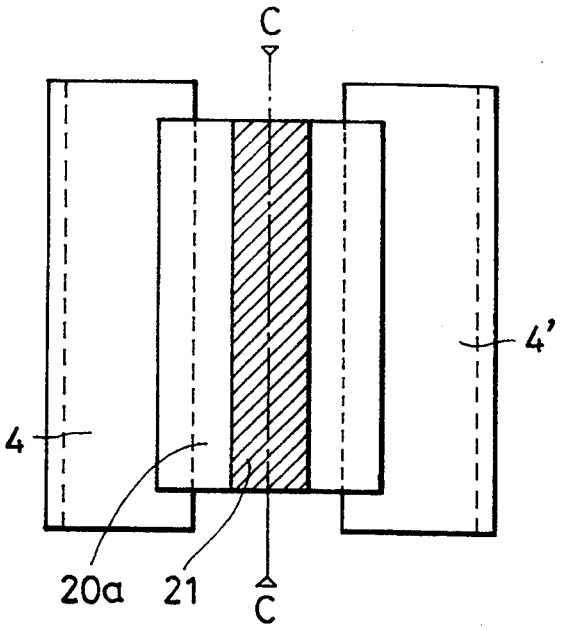
FIG. 10(A) is a diagram illustrating how charging blades are formed.

In FIG. 10(A), the rubber blade 20*a*, serving as the substrate of charging blade 20, has the size to provide two sheets of charging blades having a predetermined size. If the rubber blade 20*a* is cut along its longitudinal central axis C—C, two substrates of charging blades having the predetermined size are obtained.

On the surface of the rubber blade 20*a* having the size for two sheets is formed a pattern of the resistive surface layer 21 having a belt-like region shown by hatching symmetrically relative to the longitudinal central axis C—C by printing with a conductive paint.

The conductive rigid supporting members 4, 4' are connected to right and left side portions of the rubber blade 20*a* having the size for two sheets as one body symmetrically relative to the axis C—C using a conductive adhesive (not shown). Subsequently, by cutting the rubber blade 20*a* together with the resistive layer 21 along the longitudinal central axis C—C, two charging blades are obtained.

Figure 10B:
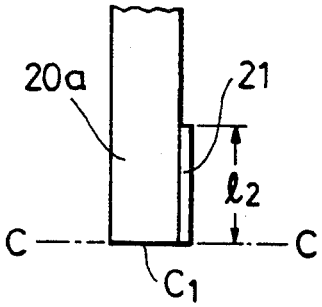
FIG. 10(B) is an enlarged view of the cut distal-end portion of the charging blade.

Since the distal-end edge of the charging blade 20 is formed with a high cutting accuracy as a result of the cutting along the axis C—C, and a cut surface $C_1$ having an excellent accuracy can be obtained as shown in FIG. 10(B), it becomes possible to perform uniform charging processing not producing charge leaks.

The formation of the resistive surface layer 21 on the rubber blade 20*a* need not be on the entire surface of the blade 20 nor on the entire surface in contact with the photosensitive drum 1, serving as the member to the charged. As shown in FIG. 10(B), the layer 21 may be formed only over a necessary and effective width $l_2$ from the free end to the supported portion of the blade 20, which width is about 1–3 mm in the present embodiment, that is, up to a position having a gap which is so large as not to leak electric charges directly from the charging blade 20 to the photosensitive drum 1 at the portion in contact with the photosensitive drum 1 of the blade 20.

Figure 11:
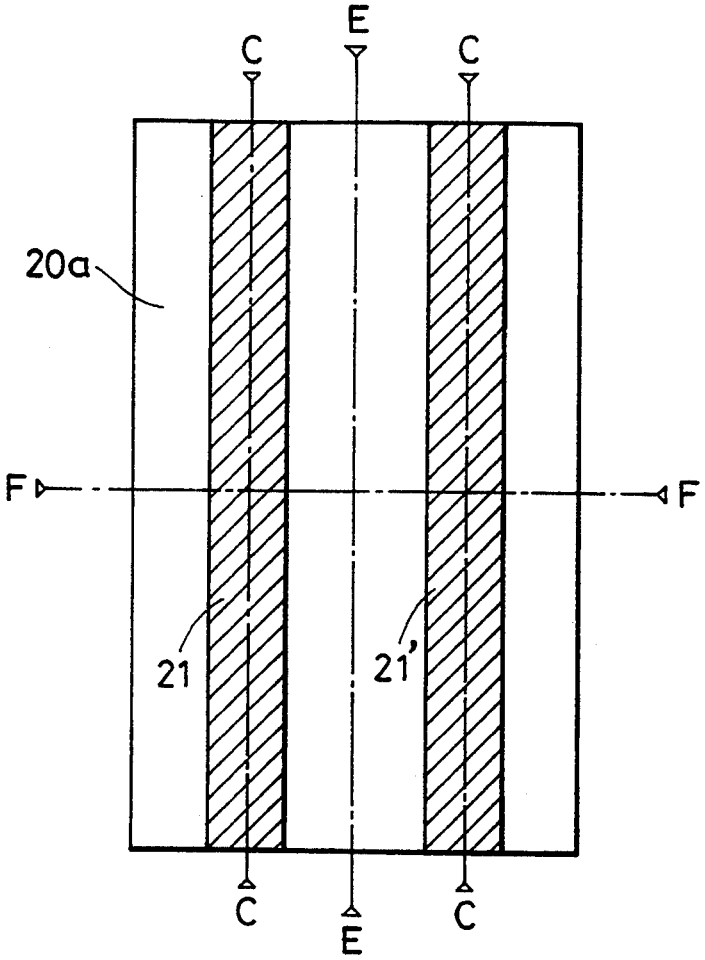
FIG. 11 is a plan view showing resistive layers formed on the surface of a rubber blade having a size for eight sheets of charging blades.

In FIG. 11, a rubber sheet 20*a*, serving as the substrate of the charging blade, has the size to provide eight sheets of charging blades having a predetermined size. On the surface of the rubber sheets 20*a* having the size for eight sheets is formed a pattern of the resistive surface layer 21 having a region shown by hatching by a printing process.

By cutting the rubber sheet 20*a* along lines E—E and F—F, four rubber blades having the size for two sheets shown in FIG. 10(A) are formed. The supporting members 4, 4' are connected to the respective blade 20*a* in the same manner as shown in FIG. 10(A), and then the resultant member is cut into two pieces. Thus, eight charging blades can be formed. Alternatively, after forming resistive layers on the rubber sheet as shown in FIG. 11, the sheet may be cut into eight blades having a predetermined size, and each respective blade may be connected to the supporting member 4.

That is, according to the above-described method, it is possible to efficiently form a large number of charging blades while reducing the number of production processes.

Figure 12:
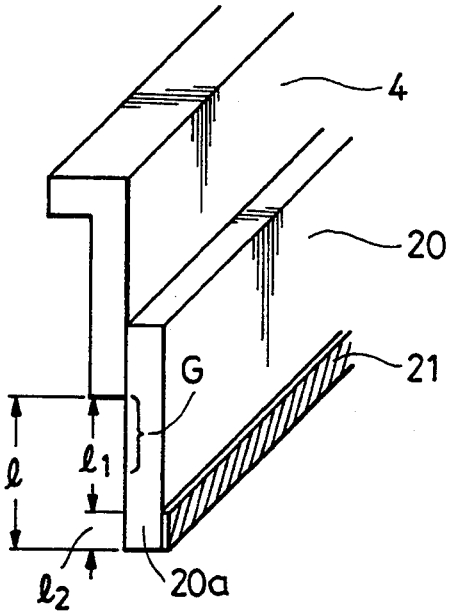
FIG. 12 is a perspective view showing another embodiment of the configuration of a charging blade.

FIG. 12 is a perspective view of a blade 20 on which a resistive surface layer 21 having a minimum necessary area is formed.

In FIG. 12, in order to stabilize the contact pressure of the charging blade 20 relative to the photosensitive member 1, the width of the resistive surface layer 21 and the width of the other portion in the width of the free length l for displacement of the blade 20 are made to be $l_1$ and $l_2$, respectively. If the resistive surface layer 21 is coated over the entire free length l of the blade 20, a rubber-like viscoelastic behavior of the rubber blade 20*a* is weakened and replaced by a plastic-like bending elastic behavior particularly when a nylon-type resin or the like. Alternatively, an urethane resin may be used for coating the blade 20, though the degree of the replacement depends on the kind of the coated material for the resistive layer. As a result, the creep and permanent deformation of the charging blade 20 relative to the photosensitive drum 1 is large, changing the contact status (pressure). That is, at least portion G on which stress is applied when the charging blade 20 is bent must have a rubber-like behavior. The rubber-like viscoelastic behavior for absorbing the eccentricity and vibration of the photosensitive drum 1 stabilizes the contact of the charging blade 20 relative to the photosensitive drum 1, and makes it possible to provide a uniform charging potential.

Figure 13A:
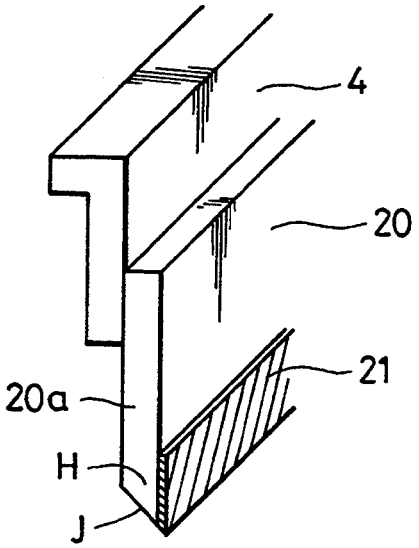
FIG. 13(A) is a perspective view showing another embodiment of the configuration of a charging blade.
Figure 13B:
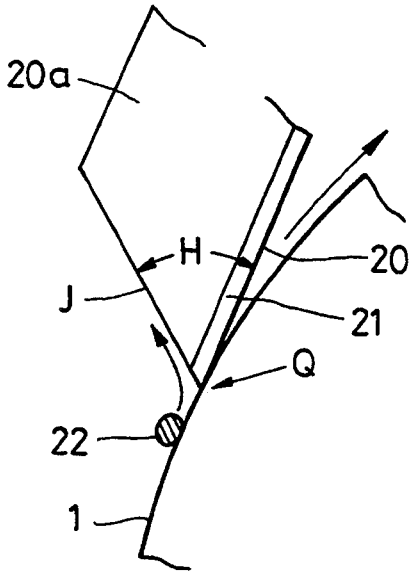
FIG. 13(B) is an enlarged cross-sectional view showing a portion of the changing blade in contact with the surface of a photosensitive drum.

FIGS. 13(A) and 13(B) show a configuration wherein contact portion Q is stabilized, and foreign matter 22 and the like hardly intervene in the charging portion (resistive-layer portion) 21. In this configuration, cut angle H of the distal-end portion of the charging blade 20 is made to be an acute angle (preferably, 60°–85°). Since the moving portion at the distal end of the charging member provides slope J having an angle (180°−H) and moves in the direction of the arrow, a force is not applied on the foreign matters 22 in the direction to intervene in the contact portion Q.

Thus, it is possible to prevent unevenness in charging caused by the intervention of foreign matter. Furthermore, by selecting the hardness and elasticity of the resistive surface layer 21 so as not to be deformed more than the rubber blade 20*a* of the blade 20, a configuration can be obtained wherein the distal end of the charging blade 20 more securely contacts the surface of the photosensitive drum 1, and the blade 20 is not worn, chipped, or peeled off in an extreme case.

That is, a hardly-deformed resin layer, serving as the resistive surface layer 21, is provided on the rubber blade 20*a* of the charging blade 20, and the resin layer contacts the photosensitive drum 1.

Although an explanation has been provided of the rubber blade, a sheet material or a film material may also be used for the substrate of the charging blade. The resistive layer 21 may be formed and configured in the same manner as in the foregoing embodiment.

Figure 14:
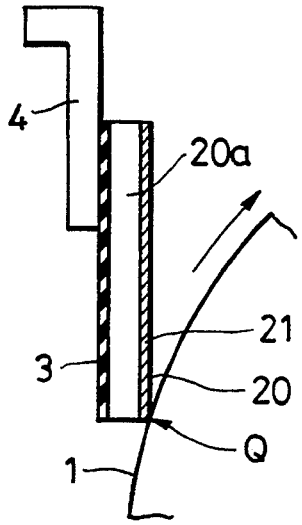

FIG. 14 shows another embodiment of the charging member.

FIG. 14 shows a configuration for dealing with potential drop at portion Q in contact with the photosensitive drum 1 of the charging blade 20 due to the resistance of the blade 20 when a voltage is applied from the supporting member 4.

That is, as described above, the electrode layer 3 is formed on the back of the charging blade 20. The electrode layer 3 is electrically connected to the conductive rigid supporting member 4 which is the voltage supply side. A bias voltage applied to the supporting member 4 is supplied to the charging blade 20 via the back electrode 3, and an electric field effective for charging is thereby provided at the contact portion Q between the charging blade 2 and the photosensitive drum 1.

The charging blade 20 shown in FIG. 14 is produced in the following way: The electrode layer 3 is first formed on the rubber blade 20*a* in the same manner as shown in FIG. 4, and the resultant rubber blade 20*a* is then connected to the supporting member 4 in the same manner as shown in FIG. 3(A). Subsequently, after providing the resistive layer 21 on the surface opposite to the surface having the electrode layer 3 of the rubber blade 20*a*, the rubber blade 20*a* having the electrode layer 3 and the resistive layer 21 is cut into a predetermined size. Accuracy in the electrode layer and the resistive layer at the free-end portion of the blade thus formed by being cut increases as in the foregoing embodiment.

Figure 15:
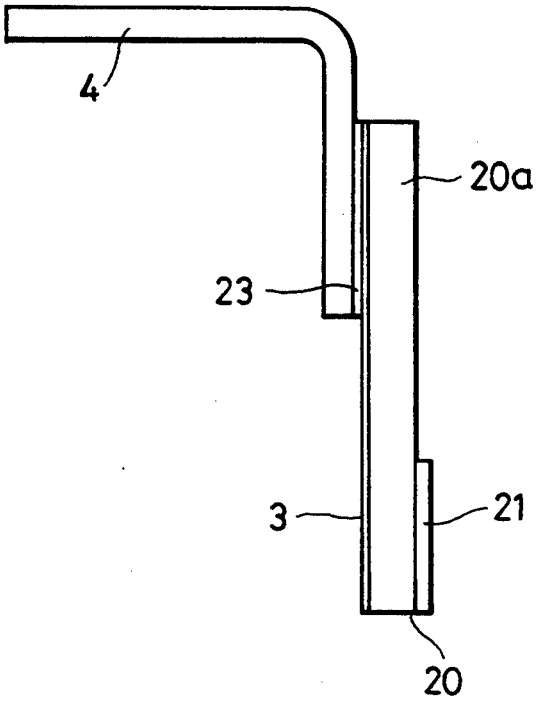

Furthermore, as shown in FIG. 15, by making the surface having the back electrode 3 the connecting surface and using a conductive adhesive 23, it becomes possible to electrically connect the charging blade 20 to the conductive rigid supporting member 4 without the need for the conductive paint 14 as in the case shown in FIGS. 8(A)–8(D). It becomes thereby possible to abbreviate the production processes.

As described above, according to the present invention, by cutting a substrate of charging blades, serving as contact charging members, into a predetermined size after previously forming a back-electrode pattern on the substrate, it is possible to form precise and stable back electrodes, and to form the pattern for a plurality of back electrodes in one process.

According to the present invention, by cutting a substrate of charging blades into a predetermined size after previously forming resistive layers on the substrate, it is possible to form precise and stable resistive layers, to provide excellent accuracy in the edge of a contact portion of a charging member relative to a member to be charged, to form a pattern for the resistive layers in one process, and to provide a stable contact.

While the present invention has been described with respect to what is presently considered to be the preferred embodiment, it is to be understood that the invention is not limited to the disclosed embodiment. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method for making a charging member for charging a member to be charged, comprising the steps of:

providing a blade member;

forming an electrode layer being supplied with electric power, on said blade member;

connecting said blade member to a supporting member for supporting said blade member; and cutting said blade member and said electrode layer at the same time;

wherein said charging member is positioned to contact said member to be charged without said electrode layer contacting said member to be charged.

2. The method of claim 1, further comprising the step of sizing the blade member such that the width of said blade member is larger than the width of said electrode layer in the direction of a generatrix of a member to be charged by the charging member.

3. The method of claim 1, further comprising the step of fabricating said blade member from an elastic material.

4. The method of claim 1, further comprising the step of fabricating said blade member from a conductive material.

5. The method of claim 1, further comprising the step of fabricating said supporting member to be rigid.

6. A method for making a charging member for charging a member to be charged, comprising the steps of:

providing a blade member;

forming an electrode layer on said blade member; and bonding a supporting member for supporting said blade member to said electrode layer after forming said electrode layer;

wherein said charging member is positioned to contact said member to be charged without said electrode layer contacting said member to be charged.

7. The method of claim 6, further comprising the step of sizing the blade member such that the width of said blade member is larger than the width of said electrode layer in the direction of a generatrix of a member to be charged by the charging member.

8. The method of claim 6, further comprising the step of fabricating said blade member from a conductive material.

9. The method of claim 6, further comprising the step of fabricating said blade member from a conductive material.

10. The method of claim 6, further comprising the step of fabricating said supporting member to be rigid.

11. The method of claim 6, further comprising the step of cutting said blade member and said electrode layer at the same time.

12. The method of claim 6, further comprising the steps of forming a resistive layer on a surface of said blade member, and cutting said blade member, said electrode layer, and said resistive layer at the same time.

13. The method of claim 1 or 6, further comprising the step of providing said electrode layer so as to extend to a free end of said blade member.

14. The method of either claim 1 or 6, further comprising the step of providing said electrode layer so as to extend to a surface of said blade member for contacting said member to be charged.

15. A charging device according to either claim 1 or 6 wherein said electrode layer is formed by coating said blade member.

16. The method of claim 1, wherein said electrode layer is bonded with said supporting member when said blade member is connected with said supporting member.

17. The method of claim 1, further comprising the steps of forming a resistive layer on a surface of said blade member, and cutting said blade member, said electrode layer, and said resistive layer at the same time.

18. A method for making a charging member for charging a member to be charged, comprising the steps of:

providing a blade member;

forming an electrode layer being supplied with electric power, on said blade member;

connecting said blade member to a supporting member for supporting said blade member; and cutting said blade member and said electrode layer at the same time, wherein a toner image is formable on said member to be charged by charging with said charging member.

19. The method of claim 1, wherein a toner image is formable on said member to be charged by charging with said charging member.

20. The method of claim 6, wherein said electrode layer is supplied with electric power.

21. A method for making a charging member for charging a member to be charged, comprising the steps of:

providing a blade member;

forming an electrode layer on said blade member; and bonding a supporting member for supporting said blade member to said electrode layer after forming said electrode layer;

wherein a toner image is formable on said member to charged by charging with said charging member.

22. The method of claim 6, wherein a toner image is formable on said member to be charged by charging with said charging member.

23. A method for making a charging member for charging a member to be charged, comprising the steps of:

providing a blade member;

forming an electrode layer being supplied with electric power, on said blade member;

connecting said blade member to a supporting member for supporting said blade member; and cutting said blade member and said electrode layer at the same time, wherein said electrode layer is formed by coating said blade member.

24. A method for making a charging member for charging a member to be charged, comprising the steps of:

providing a blade member;

forming an electrode layer on said blade member; and bonding a supporting member for supporting said blade member to said electrode layer after forming said electrode layer, wherein said electrode layer is formed by coating said blade member.

* * * * *

UNITED STATES PATENT AND TRADEMARK OFFICE

CERTIFICATE OF CORRECTION

PATENT NO. : 5,353,101

DATED : October 4, 1994

INVENTOR(S) : Adachi et al.

It is certified that error appears in the above-indentified patent and that said Letters Patent is hereby corrected as shown below:

TITLE PAGE:

[56] FOREIGN PATENT DOCUMENTS

| | | |
|---|---|---|
| "127324 | 10/1979 | Japan |
| 2282280 | 11/1990 | Japan" |

should read

| | | |
|---|---|---|
| --54-127324 | 10/1979 | Japan |
| 2-282280 | 11/1990 | Japan--. |

COLUMN 1

Line 57, "provide" should read --provides--.

COLUMN 2

Line 10, "Fur" should read --For--.
Line 20, "surface" should read --surface.--.

COLUMN 6

Line 4, "a" should read --an--.
Line 54, "regid" should read --rigid--.

COLUMN 7

Line 30, "staring" should read --starting--.

COLUMN 8

Line 56, "-like" should read --]-like--.

COLUMN 9

Line 43, "surfaces"

UNITED STATES PATENT AND TRADEMARK OFFICE

CERTIFICATE OF CORRECTION

PATENT NO. : 5,353,101 Page 2 of 2

DATED : October 4, 1994

INVENTOR(S) : Adachi et al.

It is certified that error appears in the above-indentified patent and that said Letters Patent is hereby corrected as shown below:

COLUMN 10

Line 39, "$10^6$-$10^{12}$ Ω.cm" should read --$10^8$-$10^{12}$ Ω.cm,--.

COLUMN 12

Line 20, "matters" should read --matter--.
Line 56, "2" should read --20--.

COLUMN 14

Line 27, "of" should read --of either--.
Line 35, "6" should read --6,--.

COLUMN 15

Line 5, "to" should read --to be--.

Signed and Sealed this

Twenty-first Day of March, 1995

Bruce Lehman

*Attest:*

BRUCE LEHMAN

*Attesting Officer*

*Commissioner of Patents and Trademarks*